US006601549B2

(12) United States Patent
Clarke

(10) Patent No.: US 6,601,549 B2
(45) Date of Patent: Aug. 5, 2003

(54) TWO STROKE HOMOGENOUS CHARGE COMPRESSION IGNITION ENGINE WITH PULSED AIR SUPPLIER

(75) Inventor: John M. Clarke, Chillicothe, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/029,418

(22) Filed: Dec. 20, 2001

(65) Prior Publication Data

US 2003/0116106 A1 Jun. 26, 2003

(51) Int. Cl.[7] ..... F02B 75/02
(52) U.S. Cl. ..... 123/65 VD; 123/70 R
(58) Field of Search ..... 123/65 VD, 66, 123/67, 68, 69 R, 70 R, 72, 65 B, 65 BA

(56) References Cited

U.S. PATENT DOCUMENTS

| | | | | |
|---|---|---|---|---|
| 4,995,348 A | | 2/1991 | Melchior | |
| 4,998,525 A | * | 3/1991 | Eftink | 123/559.1 |
| 5,265,564 A | | 11/1993 | Dullaway | |
| 5,934,245 A | | 8/1999 | Miller et al. | |

FOREIGN PATENT DOCUMENTS

| | | |
|---|---|---|
| WO | WO 98/07973 | 2/1998 |
| WO | WO 98/10179 | 3/1998 |
| WO | WO 99/42718 | 8/1999 |

OTHER PUBLICATIONS

J. Willand, R. Gunther Nieberding, G. Vent, and C. Enderle, Daimlerchrysler AG; The Knocking Syndrome: Its Cure And Potential, 5 pgs, Automotive Engineering International (64–68), Dec. 1999, USA.

R. Stanglmaier, C. Roberts, Homogenous Charge Compression Ignition (HCCI): Benefits, Compromises, and Future Engine Applications, 8 pgs, Society of Automotive Engineers (1999–01–3682)(1–8), 1999, USA.

S. Onishi, S. Hong Jo, K. Shoda, P. Do Jo, and S. Kato, Active Thermo–Atmosphere Combustion (ATAC) –A New Combustion Process For Internal Combustion Engines, 12 pgs, SAE Technical Paper Series 790501 (1–12), 1979, USA.

* cited by examiner

*Primary Examiner*—Noah P. Kamen
(74) *Attorney, Agent, or Firm*—Liell & McNeil

(57) ABSTRACT

A two stroke homogenous charge compression ignition engine includes a volume pulsed air supplier, such as a piston driven pump, for efficient scavenging. The usage of a homogenous charge tends to decrease emissions. The use of a volume pulsed air supplier in conjunction with conventional poppet type intake and exhaust valves results in a relatively efficient scavenging mode for the engine. The engine preferably includes features that permit valving event timing, air pulse event timing and injection event timing to be varied relative to engine crankshaft angle. The principle use of the invention lies in improving diesel engines.

17 Claims, 4 Drawing Sheets

$$\frac{A}{B} = \frac{50}{49} \; ; \frac{C}{D} = \frac{7}{5} \quad \frac{E}{F} = \frac{7}{5} \quad \frac{A}{F} = 2$$

TWO STROKE HOMOGENOUS CHARGE COMPRESSION IGNITION ENGINE WITH PULSED AIR SUPPLIER

GOVERNMENT LICENSE RIGHTS

The U.S. Government has a paid-up license in this invention and the right in limited circumstances to require the patent owner to license others on reasonable terms as provided for by the terms of DE-FC05-97OR22605, awarded by the Department of Energy. In other words, this invention was made with Government support under DE-FC05-97OR22605 awarded by the Department of Energy. The Government has certain rights in this invention.

TECHNICAL FIELD

The present invention relates generally to two stroke diesel engines, and more particularly to two stroke homogenous charge compression ignition engines that utilize a pulsed air supply.

BACKGROUND

Engineers are constantly seeking new ways to improve the efficiency and reduce emissions from diesel engines. One recently recognized avenue for reducing emissions is commonly referred to as homogenous charge compression ignition. Unlike a conventional diesel engine, a homogenous charge compression ignition engine injects fuel into the combustion space when the engine piston is closer to its bottom dead center position than it is to its top dead center position. By injecting fuel early in the compression stroke, the fuel has a better opportunity to mix with the air in the cylinder such that a relatively homogenous lean mixture of air and fuel is present when ignition occurs at a time when the engine piston is near its top dead center position. Although the strategy of utilizing homogenous charge compression ignition can result in substantial reductions in emissions, such a strategy only appears to work well at engine loads less than about 50%. Thus, a strategy in a four stroke diesel engine that utilizes homogenous charge compression ignition at lower engine loads appears promising; however, utilizing such a strategy at higher engine loads remains problematic.

Although two stroke engines have gained a reputation of producing high emissions over their four stroke counterparts, engineers have began to revisit modified two stroke engines as a possible strategy for an improved diesel engine. For instance, SAE Paper No. 790501 entitled Active Thermo-Atmosphere Combustion (ATAC)—A New Combustion Process For Internal Combustion Engines describes a two stroke engine operation that utilizes homogenous charge compression ignition in a partly loaded engine. However, this reference fails to suggest an efficient scavenging strategy, and is thus plagued by some of the same problems that have historically been linked to two stroke engines. This reference also fails to provide any suggestion as to how to improve efficiency across an engine's speed and load range.

In another example two stroke engine, such as that described in U.S. Pat. No. 5,265,564 to Dullaway, scavenging is made substantially more efficient by the utilization of a pumped air supply that permits the usage of conventional poppet type intake and exhaust valves. The combination of a pulsed air supply with conventional poppet type intake and exhaust valves appears to permit an efficient scavenging process by allowing the valves to open and close when pressure differentials across the valve are relatively low, which appears to be a gain not easily realizable in a conventional turbocharged engine. Although Dullaway appears to teach some improvements, especially in the area of gas exchange in a two stroke engine, it continues to rely upon a conventional diesel injection strategy that results in higher emissions. In other words, Dullaway continues to promote fuel injection when the engine piston is near its top dead center position which results in undesirably higher emissions. In addition, Dullaway also appears to suffer from an inability to improve performance across the engine's operating range, by having event timings apparently optimized for a single engine speed.

The present invention is directed to these and other problems associated with diesel engine technology.

SUMMARY OF THE INVENTION

In one aspect, a two stroke homogenous charge compression ignition engine includes a reciprocating piston positioned in a cylinder defined by an engine housing. A fuel injector is attached to the engine housing and is at least partially positioned in the cylinder. The fuel injector includes a nozzle outlet that begins to open at least once during each reciprocation of the piston when the piston is closer to a bottom dead center position than to a top dead center position. An intake valve is positioned above the piston and opens at least once during each reciprocation of the piston. Likewise, an exhaust valve is positioned above the piston and is opened at least once during each piston reciprocation. A volume pulsed air supplier, which produces at least one volume pulse with each piston reciprocation, is fluidly connected to the cylinder when the intake valve is in its open position.

In another aspect, a method of operating an engine includes a step of scavenging a cylinder at least in part by opening an intake passage and an exhaust passage to the cylinder. A volume pulse of air is sent to the cylinder via the intake passage during each reciprocation of the power piston in the cylinder. Fuel is injected at least once during each reciprocation of the power piston into the cylinder when the power piston is closer to a bottom dead center position than to a top dead center position.

DETAILED DESCRIPTION

Figure 1:
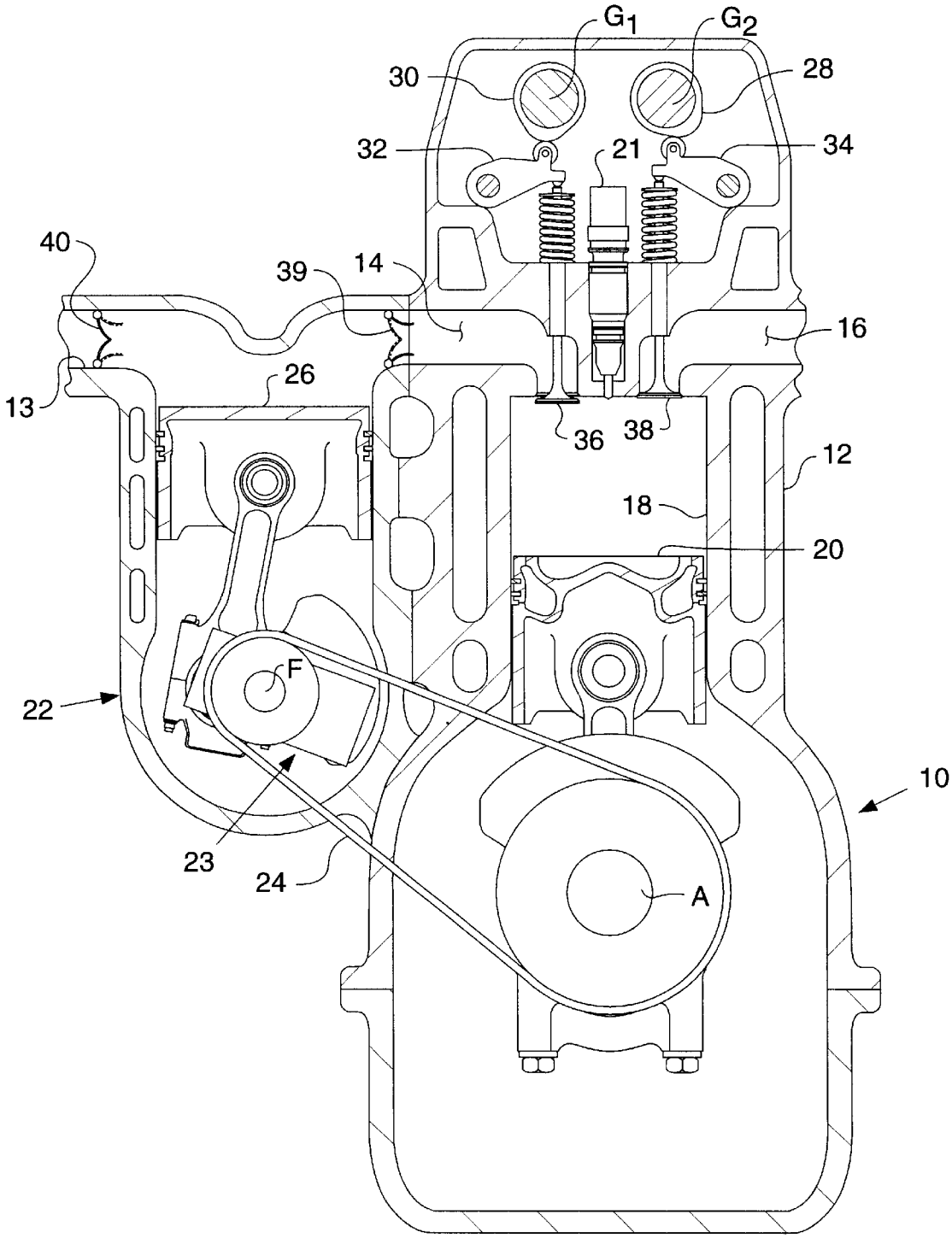
FIG. 1 is a diagrammatic sectioned end view of an engine according to the present invention.
Figure 6A:
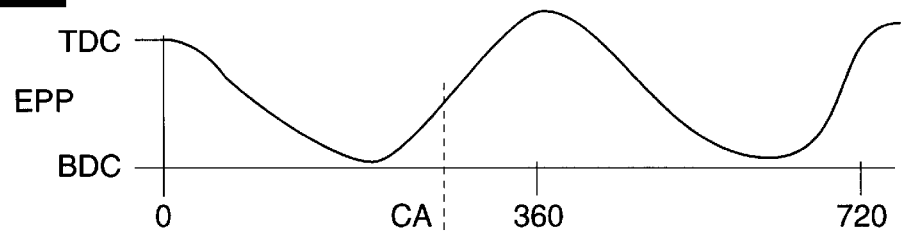
FIGS. 6A–E are graphs of engine piston position (EPP), pump piston position (PPP), injector state (INJ), intake valve position (IVP) and exhaust valve position (EVP) verses crankshaft angle (CA) for two engine cycles according to the present invention.
Figure 6B:
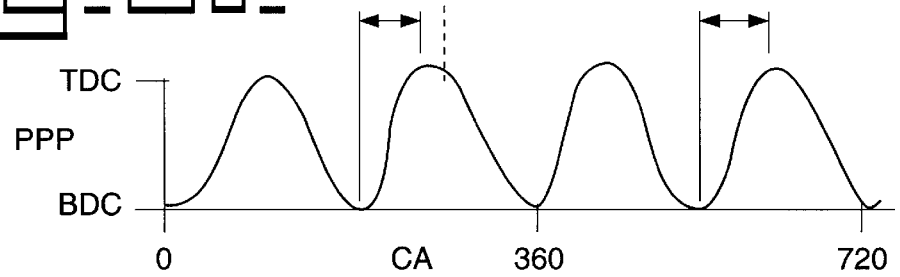
Figure 6C:
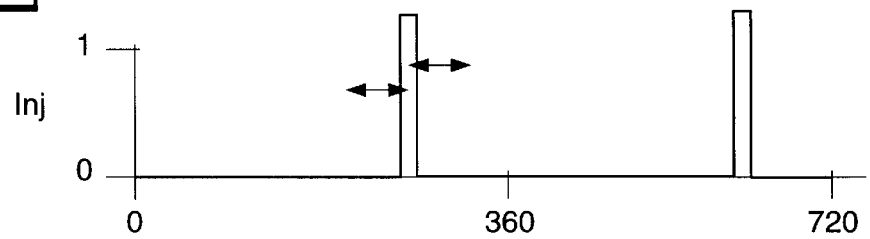
Figure 6D:
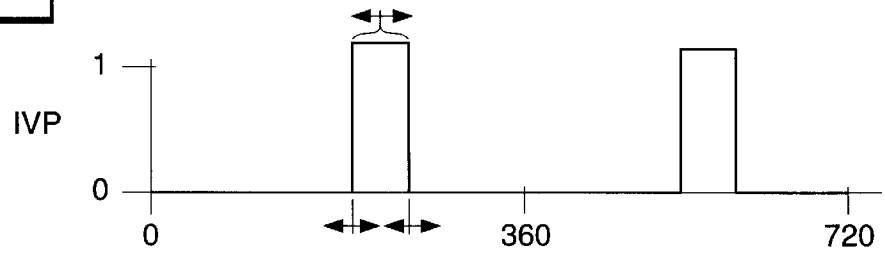

Referring to FIG. 1, an engine 10 includes an engine housing 12 that defines at least one cylinder 18. A power piston 20 is positioned to reciprocate in cylinder 18 and is operably coupled via a conventional linkage to rotate a crankshaft A. Engine housing 12 defines an intake passage 13 connected to a transfer passage 14 that is open to cylinder 18 when intake valve 36 is in its open position. Passages 13 and 14 may include check valves 39 and 40 for directing flow in one direction. Likewise, engine housing 12 defines an exhaust passage 16 that is open to cylinder 18 when exhaust valve 38 is in its open position. A fuel injector 21 is attached to the engine housing and includes a tip at least partially positioned in cylinder 18. The fuel injector 21 could be any suitable diesel type fuel injector, such as hydraulically actuated, cam actuated, etc., but is preferably an electronically controlled fuel injector that operates with a timing not directly linked to the crankshaft A rotation angle. Although not desirable, fuel injector 21 could even be a relatively simple cam actuated fuel injector with a mechanical linkage directly coupled to the crankshaft. Also included as part of engine 10 is a volume pulsed air supplier pump 22 that is attached to or incorporated into engine housing 12. Volume pulsed air supplier pump 22 is preferably of the type described in U.S. Pat. No. 5,265,564 to Dullaway and commercially available from Rotec Design Limited Ltd. of Brisbane, Australia. Pump 22 includes a pump shaft F that is driven via a drive belt 24 or gear and a gear based phase change mechanism 23 to rotate at twice crankshaft A speed. Thus, volume pulsed air supplier pump 22 includes a pump piston 26 that reciprocates at twice the reciprocation rate of power piston 20 as illustrated in FIGS. 6A and 6B.

Engine 10 also preferably includes an intake cam shaft $G_1$ that includes a cam 30, which rotates in contact with a rocker arm 32 to open and close intake valve 36. Preferably, engine 10 also includes an exhaust cam shaft $G_2$ that rotates in contact with a conventional rocker arm assembly 34 to open and close exhaust valve 38. Preferably, intake cam shaft $G_1$ and exhaust cam shaft $G_2$ are operably coupled to crankshaft A via a mechanical linkage to rotate at the same speed as crankshaft A. Thus, intake valve 36 and exhaust valve 38 are operable to open at least once with each reciprocation of engine piston 20 as in a two stroke engine cycle. Likewise, fuel injector 21 includes a nozzle outlet that opens at least once during each reciprocation of engine piston 20, and injects fuel when piston 20 is closer to a bottom dead center position than to a top dead center position in order to produce a homogenous charge. Fuel injector 21 can be controlled to operate in this two stroke mode via any conventional manner such as with an appropriate mechanical linkage to crankshaft A and/or some type of electronic control of a type well known in the art.

Figure 2:
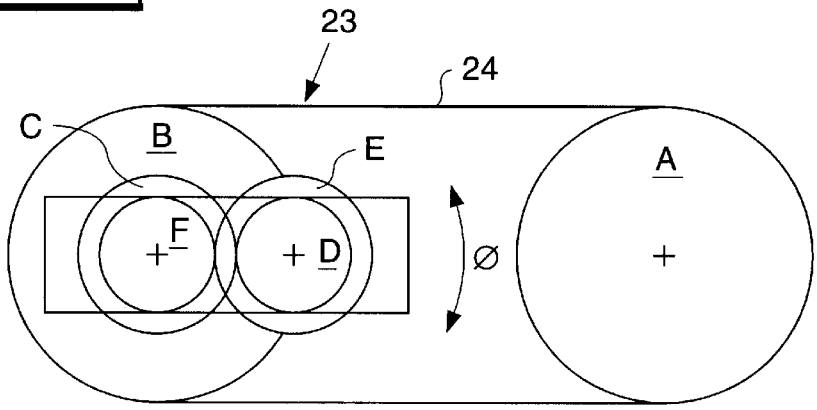
FIG. 2 is a schematic end view of a gear based phase change mechanism according to one aspect of the present invention.
Figure 3:
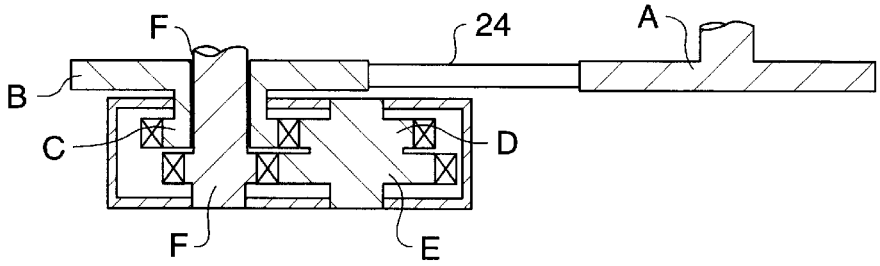
FIG. 3 is a partially sectioned schematic top view of the gear based phase change mechanism of FIG. 2.

Referring to FIGS. 2 and 3, an example gear phase change mechanism 23 includes gears B, C, D, and E that are operably positioned between crankshaft A and pump shaft F. The overall ratio A/F is preferably equal to two, which can be accomplished, for example, with diameter ratios of A/B=50/49; C/D=7/5; and E/F=7/5. Gear based phase change mechanism 23 provides a relatively straight forward means of varying the phase angle Ø of pump shaft F relative to crankshaft A. Gear based phase change mechanism 23 provides a preferred means by which the phase angle Ø of pump shaft F can be changed relative to that of a crankshaft A. Mechanism 23 could be actuated in any suitable manner, such as by a rack and pinon device and/or a stepper motor. However, those skilled in the art will appreciate that a phase change means is preferred but not required for the present invention. In addition, other known strategies for varying phase angle of one rotating part relative to another rotating part could be substituted in place of the gear based phase change mechanism 23 illustrated.

Figure 4:
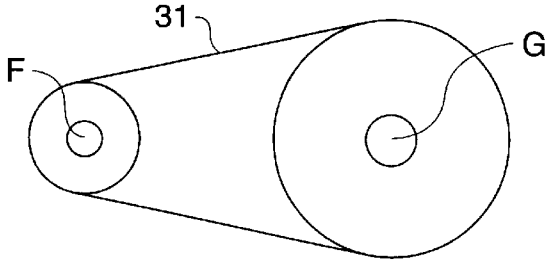
FIG. 4 is a schematic end view of a drive linkage between a cam shaft and a pump shaft according to another aspect of the present invention.

Referring to FIG. 4, in one variation of the present invention, the pump shaft F drives the intake and exhaust cam shaft(s) G via a toothed drive belt 31 in a conventional manner. In this way, pump shaft F and cam shaft(s) G preferably have a 1/2 diameter ratio such that cam shaft(s) G rotates at half the pump shaft speed but at the same speed as crankshaft A. In the variation of FIG. 4, pump shaft F and cam shaft G would have fixed relative timing to each other but would have some variable timing capability relative to crankshaft A via gear based phase change mechanism 23 illustrated in FIGS. 1–3. Thus, FIG. 4 illustrates one possible alternative to a direct mechanical linkage between crank shaft A and cam shafts $G_1$ and $G_2$ of FIG. 1.

In still another alternative embodiment, crank shaft A is directly mechanically linked to cam shafts $G_1$ and $G_2$ as in FIG. 1, but included is a separate gear based phase change mechanism that would allow the phase angle of the cam shafts relative to the crankshaft A to be varied independent from the phase angle of the pump shaft F relative to crankshaft A. The gear based phase change mechanism for this alternative embodiment would look much like the mechanism 23 of FIGS. 2 and 3 except the ratio A/B would be 25/49. Still another alternative would be to include a separate gear based phase change mechanism in the mechanical linkage between each of the pump shaft F and crankshaft A, cam shaft $G_1$ and crankshaft A and cam shaft $G_2$ and crankshaft A. Such an alternative would allow for independent phase control of pump 22, intake valve 36, and exhaust valve 38 independent of one another.

Figure 5:
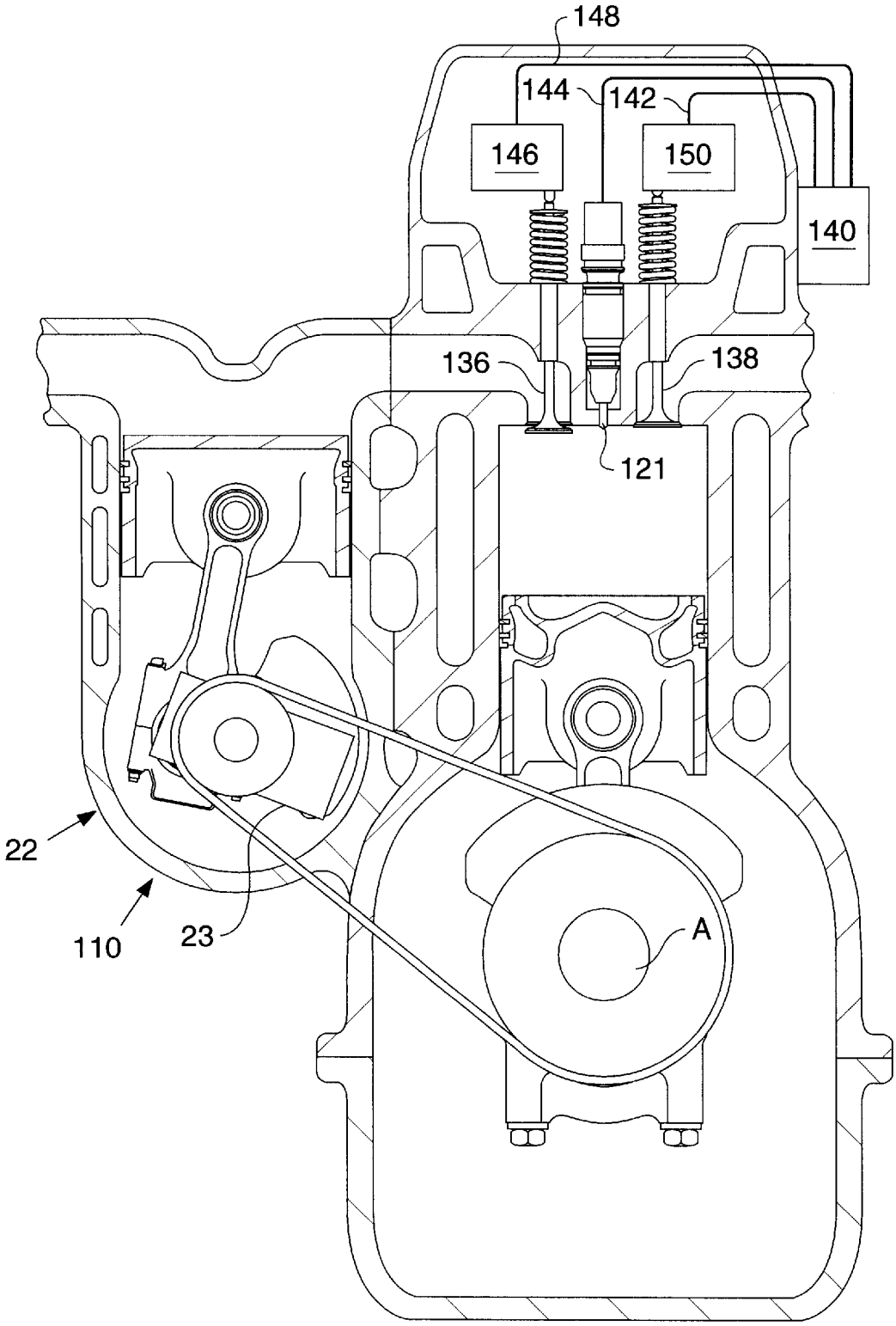
FIG. 5 is a diagrammatic sectioned end view of an engine according to another embodiment of the present invention.

Referring to FIG. 5, an engine 110 according to another embodiment of the present invention includes electrically controlled valves and fuel injector as opposed to the cam actuated valves illustrated in relation to the engine 10 of FIG. 1. In all other aspects, engine 110 is substantially identical to engine 10 of FIG. 1, including the positioning of the gear based phase change mechanism 23 between volume pulsed air supplier pump 22 and crankshaft A. In this embodiment, a conventional electronic control module 140 is in control communication with an electronically controlled fuel injector 121 via a communication line 144. In addition, electronic control module 140 is in communication control with an electronically controlled intake valve actuator 146 which is operably coupled to intake valve 136, via a communication line 148. ECM 140 also controls phase change mechanism 23 via a separate communication line. Finally, electronic control module 140 is in control communication with an electronically controlled exhaust valve actuator 150, which is operably coupled to exhaust valve 138, via a communication line 142. Valve actuators 146 and 150 could be any suitable electronically controlled actuators, but are preferably electro-hydraulic actuators of the type associated with Caterpillar Inc. of Peoria Ill. Thus, engine 110 of FIG. 5 allows for a variable timing of intake and exhaust valve opening and closing events as well as electronic control over fuel injection timing and quantity independent of crank shaft angle.

INDUSTRIAL APPLICABILITY

Figure 6E:
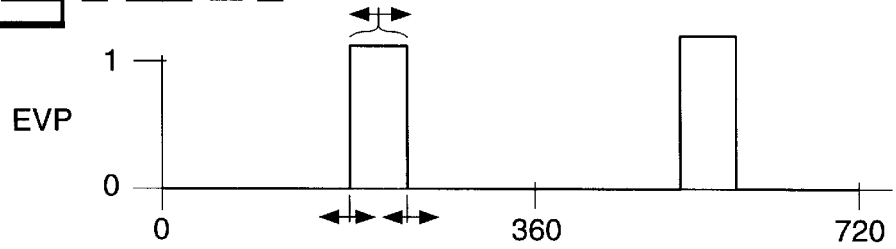

Referring to FIGS. 6A–E, the state of several engine components are graphed against crank angle (CA) for two engine cycles according to the present invention. FIG. 6A shows engine piston position (EPP) versus crank angle (CA), and shows power piston 20 (FIG. 1) reciprocating once with each revolution of the crankshaft A. Thus, at 0° crank angle, piston 20 is at a top dead center (TDC) position and at a bottom dead center (BDC) position at a crank angle of 180°, and back to a top dead center position at a crank angle of 360°. FIG. 6B shows that pump piston 26 (FIG. 1) reciprocates twice the rate of power piston 20. Thus, volume pulsed air supplier pump 22 produces two volume pulses with each reciprocation of engine piston 20. Therefore, in a conventional multi-piston engine, one would likely utilize appropriate valving (not shown) of the type described in U.S. Pat. No. 5,265,564 to Dullaway to use one pump 22 for each pair of engine cylinders. It is important to note that the upward stroke of pump piston 26 preferably is timed to occur when the power piston 20 is near its bottom dead center position so that scavenging can occur in a somewhat conventional manner when the engine piston is in the region of its bottom dead center position. In addition, the volume pulse produced by the upward stroke of pump piston 26 preferably has a duration of about 90° or less of crankshaft rotation. FIG. 6E shows that the exhaust valve 38 preferably opens slightly before the opening of intake valve 36 (FIG. 6D) in order to move a substantial portion of the combustion products into exhaust passage 16 toward the end of the power stroke of engine piston 20. Shortly thereafter, intake valve 36 opens in order to begin the scavenging portion of the engine cycle. In addition, intake valve 36 preferably opens when pump piston 26 is near its bottom dead center position so that a pressure gradient between intake passage 14 and engine cylinder 18 is relatively low. This allows the valve to opened efficiently because only small amount of fluid flow occurs across the intake valve seat 36 when it is opening. With both intake valve 36 and exhaust valve 38 are in their open positions, pump piston 26 undergoes its upward stroke to remove a majority of the remaining combustion products from engine cylinder 18 while bringing fresh air for a subsequent combustion event into the same.

Preferably each reciprocation of pump piston 26 displaces an amount of air equal to or greater than the volume of fluid displaced with each reciprocation of engine piston 20. Thus, pump 22 could be said to have a scavenging volume equal to or greater than the piston displacement volume. This insures that adequate fresh air is pushed into engine cylinder 18 in order to remove an adequate amount of the previous combustion products to insure good engine performance. At about the time that pump piston 26 reaches its top dead center position, intake valve 36 and exhaust valve 38 are closed to end the scavenging period. Shortly after engine cylinder 18 becomes closed with the closure of valves 36 and 38, at least one fuel injection event begins when engine piston 20 is closer to its bottom dead center position than to its top dead center position. Those skilled in the art will appreciate that one or more injection events are desirable, with at least one of those events beginning when the piston is closer to a bottom position than a top position. This provides adequate time for the injected fuel to mix thoroughly with the air in cylinder 18 to produce a homogenous charge that should spontaneously ignite when engine piston 20 is near its top dead center position.

The various arrows in FIGS. 6A–E show how the preferred versions of the invention permit various timing control of the valving, air pulse and injection events relative to crankshaft angle. For instance, the engine of FIG. 1 could vary the phase angle of the entire intake and exhaust events as per the left and right arrows shown at the top of those events in FIGS. 6D and 6E. On the other hand, the engine of FIG. 5 would have the ability to vary timing of both the opening and closing of both the intake and exhaust valve events as shown by the arrows at the bottom of those events in FIGS. 6D and 6E.

Homogenous charge compression ignition is a newly appreciated combustion mode that has demonstrated a potential for extremely low $NO_x$ and Soot emissions. However, homogenous charge compression ignition generally requires more air per unit power than is required by conventional diesel combustion modes. In order to avoid a consequent increase in engine size for the production of equal power, the present invention contemplates the adoption of a two stroke cycle. Unlike existing two stroke diesel engines, the present invention would preferably use poppet type valves for both intake and exhaust control. The bolt on air pump 23 of the present invention can be utilized to convert a conventional four stroke engine into a two stroke engine of relatively equal power with each firing requiring about half of the fuel required by the conventional four stroke engine. Thus, the present invention contemplates a pulsed air supplier, such as the pump illustrated, which is different from the relatively high constant pressure produced in a turbo-charged system. However, a turbo-charged system could be modified to operate in much the same way as the pulsed air supplier pump of the present invention. For instance, a valve could be provided that opened once with each pump reciprocation which would cause the air flow in the intake passage to mimic that produced by the pump illustrated in FIG. 1. Thus, those skilled in the art will recognize that any suitable mechanism could be relied upon to produce the air scavenging pulse according to the present invention. In more sophisticated pulsed air suppliers, it might be desirable to have the ability to modify the air pulse wave form and/or duration in order to have the ability to further improve performance at different engine operating conditions.

Although not required, the present invention recognizes the desirability of having the ability to adjust air pulse event timing, intake valve event timing and exhaust valve event timing to improve performance across the engine's operating range. Preferably, the engine has the ability to electronically control all four valve events (exhaust and intake opening and closing). Such control could be modified, even between cycles, to achieve changes in effective compression ratio and hence temperature at power piston top dead center. Such control would effectively allow adjustment to retard ignition timing, which must be indirectly controlled since fuel injection occurs early in the compression cycle well before combustion is to occur. In addition, this control could be utilized to allow for increased exhaust gas recirculation in the event of a desirable ability to advance ignition timing. Thus, the present invention preferably concerns a combination of variable valve timing for control of homogenous charge compression ignition combustion in a poppet valve two stroke engine.

The present invention also contemplates a more positive but less flexible method of changing valve timing on a two stroke engine by changing the phase difference between the pump shaft and/or cam shaft relative to the crankshaft. This same strategy could also produce a way to achieve increases in compression temperature and exhaust energy starting while reducing compression ratio to control peak pressure and reduce "blow down" loses at high power. This methodology has the advantage of reduced complexity over a completely electronically controlled valves.

The present invention also contemplates inserting a phase change gear between the air pump and the crankshaft to allow variation of the timing of the scavenging pulse relative to the position of the power piston. In idealized high efficiency mode, the pump piston stroke scavenges the power cylinder during the first half of the power piston upstroke. In doing so, it moves twice the trapped volume through the power cylinder, assuming equal swept volumes for the pump and power cylinders. The expansion stroke of the power piston is used in full so that expansion to near intake pressure is achieved and blow down is minimized. In a higher power mode, the trap charge is increased by advancing the scavenge period so that it occurs nearer the low end of the power piston stroke. In this way, the trapped volume is larger and, if the exhaust valve closing is advanced, there is some supercharging of the cylinder from the pump. This mode would also be beneficial to turbocharger boosting.

Other aspects and features of the present invention can be obtained from a study of the drawings, the disclosure, and the appended claims.

What is claimed is:

1. A two stroke homogeneous charge compression ignition engine comprising:

an engine housing defining at least one cylinder;

a reciprocating piston positioned in said cylinder;

a fuel injector attached to said engine housing and being at least partially positioned in said cylinder, and including a nozzle outlet that begins to open at least once during each reciprocation of said piston when said piston is closer to a bottom dead center position than to a top dead center position;

an intake valve positioned above said piston and being in an open position at least once during each reciprocation of said piston;

an exhaust valve positioned above said piston and being in an open position at least once during each reciprocation of said piston;

a volume pulsed air supplier fluidly connected to said cylinder when said intake valve is in said open position and producing at least one volume pulse with each reciprocation of said piston;

a crank shaft connected to said piston; and a phase adjuster operably positioned between said crank shaft and said volume pulsed air supplier.

2. The two stroke homogeneous charge compression ignition engine of claim 1 wherein said phase adjuster is a portion of at least one mechanical linkage operably coupling said crank shaft to said intake valve, said exhaust valve and said volume pulsed air supplier; and said mechanical linkage activating said intake valve, said exhaust valve and said volume pulsed air supplier with a fixed timing relative to one another.

3. The two stroke homogeneous charge compression ignition engine of claim 1 wherein said phase adjuster includes a cam shaft operably coupling said crank shaft to said intake valve and said exhaust valve; and said phase adjuster having a first position in which said cam shaft has a first phase angle relative to said crank shaft, and a second position in which said cam shaft has a second phase angle relative to said crank shaft.

4. The two stroke homogeneous charge compression ignition engine of claim 1 wherein said phase adjuster includes a gear based phase change mechanism.

5. The two stroke homogeneous charge compression ignition engine of claim 1 including at least one electronic actuator operably coupled to said intake valve and said exhaust valve.

6. The two stroke homogeneous charge compression ignition engine of claim 5 wherein said at least one electronic actuator includes a first electronic actuator operably coupled to said intake valve; and a second electronic actuator operably coupled to said exhaust valve.

7. The two stroke homogeneous charge compression ignition engine of claim 1 wherein said at least one volume pulse is a single volume pulse having a scavenging volume that is equal or greater than a piston displacement volume.

8. The two stroke homogeneous charge compression ignition engine of claim 7 including a crank shaft connected to said piston; and said single volume pulse has a duration that is about 90° of crank shaft rotation.

9. A two stroke homogeneous charge compression ignition engine comprising:

an engine housing defining at least one cylinder;

a reciprocating power piston positioned in said cylinder;

a fuel injector attached to said engine housing and being at least partially positioned in said cylinder, and including a nozzle outlet that begins to open at least once during each reciprocation of said power piston when said power piston is closer to a bottom dead center position than to a top dead center position;

an intake valve positioned above said power piston and being in an open position at least once during each reciprocation of said power piston;

an exhaust valve positioned above said power piston and being in an open position at least once during each reciprocation of said power piston;

a volume pulsed air supplier including at least one reciprocating pump piston and being fluidly connected to said cylinder when said intake valve is in said open position;

a crank shaft connected to said power piston; and a pump mechanical linkage, which includes a rotating pump shaft and a pump phase adjuster, operably coupling said crank shaft to said volume pulsed air supplier.

10. The two stroke homogeneous charge compression ignition engine of claim 9 wherein said pump phase adjuster includes a gear based phase change mechanism.

11. The two stroke homogeneous charge compression ignition engine of claim 10 including at least one valve mechanical linkage, which includes a cam shaft, operably coupling said crank shaft to said intake valve and said exhaust valve;

said valve mechanical linkage including at least one valve phase adjuster having a first position in which said cam shaft has a first phase angle relative to said crank shaft, and a second position in which said cam shaft has a second phase angle relative to said crank shaft.

12. The two stroke homogeneous charge compression ignition engine of claim 10 including at least one electronic actuator operably coupled to said intake valve and said exhaust valve.

13. The two stroke homogeneous charge compression ignition engine of claim 10 wherein a pump piston displacement volume is equal or greater than a power piston displacement volume.

14. The two stroke homogeneous charge compression ignition engine of claim 13 wherein said single volume pulse has a duration that is about 90° of crank shaft rotation.

15. A method of operating a diesel engine, comprising the steps of:

scavenging at least in part by opening an intake passage and an exhaust passage to a cylinder and sending a volume pulse of air to said cylinder via said intake passage during each reciprocation of a power piston in said cylinder;

injecting fuel directly into said cylinder at least once during each reciprocation of said power piston, and at least a portion of the fuel being injected when said power piston is closer to a bottom dead center position than to a top dead center position; and adjusting a phase of said volume pulse of air relative to a crank shaft angle.

16. The method of claim 15 wherein said step of sending a volume pulse of air includes a step of moving a pump piston from a bottom position to a top position.

17. The method of claim 16 wherein said step of adjusting a phase includes a step of moving a gear based phase change mechanism from a first position to a second position.

* * * * *